US005109748A

United States Patent [19]

Bertiller et al.

[11] Patent Number: 5,109,748

[45] Date of Patent: May 5, 1992

[54] SMOKE EXHAUST DEVICE FOR GUN BARRELS

[75] Inventors: Roland Bertiller, Schramberg; Hubert Schneider, Dietingen; Gerd Dieterle, Dornhan, all of Fed. Rep. of Germany

[73] Assignee: Mauser-Werke Oberndorf GmbH, Oberndorf, Fed. Rep. of Germany

[21] Appl. No.: 701,460

[22] Filed: May 15, 1991

[30] Foreign Application Priority Data

May 17, 1990 [DE] Fed. Rep. of Germany ..... 4015822

[51] Int. Cl.[5] ..... F41A 13/08

[52] U.S. Cl. ..... 89/1.2

[58] Field of Search ..... 89/1.2, 14.05; 137/512.15, 854, 855

[56] References Cited

U.S. PATENT DOCUMENTS

| | | | |
|---|---|---|---|
| 1,334,507 | 3/1920 | Shartle | 137/854 |
| 2,766,661 | 10/1956 | Margulis | 89/1.2 |
| 2,791,940 | 5/1957 | Speake et al. | 89/1.2 |
| 2,807,986 | 10/1957 | Howard et al. | 89/1.2 |
| 3,118,342 | 1/1964 | Campione et al. | 89/1.2 |
| 3,122,055 | 2/1964 | Roeck | 89/1.2 |
| 3,377,918 | 4/1968 | Austin et al. | 89/1.2 |
| 3,715,955 | 2/1973 | Folley et al. | 89/1.2 |
| 4,319,452 | 3/1982 | Morita | 137/512.15 |
| 4,724,937 | 2/1988 | Fannin et al. | 137/512.15 |

OTHER PUBLICATIONS

Dubbel, "Taschenbuch für Maschinenbau", [Pocket Book for Machine Design], Springer-Verlag, Berlin, Heidelberg, New York, London, Paris, Tokyo, 1987, p. G 157.

*Primary Examiner*—David H. Brown

*Attorney, Agent, or Firm*—McGlew & Tuttle

[57] ABSTRACT

To reduce the concentration of the gases generated during firing in a combat space behind a gun barrel, a smoke exhaust device (8) is arranged in a middle zone of the gun barrel (7). This smoke ehaust device (8) is joined to the gun barrel (7) in a gas-tight manner in the outward direction and is connected, in the inward direction, to the caliber bore (5) of the gun barrel (7) via an obliquely extending blow-off bore (3) and via Y-shaped valve bores (2). Pressure is admitted into the valve bores (2) through a check valve (6) made in the form of an assembly of layered leaf springs. Good filling of the smoke exhaust device with gases generated during firing is thus possible along with very rapid closing of the check valve, which is decisive for the desired long blow-off time of the gases through the blow-off bore (3).

10 Claims, 3 Drawing Sheets

SMOKE EXHAUST DEVICE FOR GUN BARRELS

FIELD OF THE INVENTION

The present invention pertains to a smoke exhaust device for gun barrels, which is formed essentially by a hollow cylinder, which is arranged around the gun barrel, is connected to it in a gas-tight manner, and is connected to the caliber bore of the gun barrel through at least one blow-off bore extending obliquely to the muzzle of the gun barrel.

BACKGROUND OF THE INVENTION

A smoke exhaust device of the above-described type is shown in the description "Turm und Bewaffnung Kampfpanzer Leopard A4" [Gun Turret and Armament of the Leopard A4 Combat Tank], June 1974, pp. 55 and 56.

These smoke exhaust devices are used to keep the combat space practically free from gunpowder gases during firing. During firing, part of the high-pressure gases enters the smoke exhaust device through the bores directed obliquely upward in the gun barrel. When a shell has left the gun barrel, the gas collected in the smoke exhaust device flows again out of the bores at a relatively high velocity and also entrains the gases located in the rear part of the gun barrel in the direction of the muzzle.

However, practice has shown that especially in the case of gun barrels of relatively small caliber, the function of this prior-art smoke exhaust device is not sufficient to reduce the CO value in the combat space greatly enough to rule out injury to the persons in the combat space.

SUMMARY AND OBJECTS OF THE INVENTION

It is an object of the present invention to provide a smoke exhaust device for gun barrels of the class described in the introduction, which guarantees good function, despite simple design, in the case of both large and small sizes and gun barrel calibers.

This task is accomplished according to the present invention by providing at least one valve bore between the caliber bore of the gun barrel and the smoke exhaust device, to which valve bore pressure is admitted by a check valve arranged in the smoke exhaust device.

According to other features of the invention, a valve bore extends from the caliber bore in a Y-shaped design with two oblique inlet openings, extending in opposite directions. These oblique inlet openings enclose a low angle with respect to the longitudinal axis of the gun barrel. A plurality of valve bores may also be provided, preferably arranged at regularly spaced locations from one another over the circumference of the gun barrel. The valve bores may be provided extending from an angular groove provided in the caliber bore. The check valve is preferably formed by an assembly of layered leaf springs closing off the inlet openings of the valve bore. The layered leaf springs are preferably held in an exhaust chamber by a bolt whose longitudinal axis passes through the longitudinal axis of the lower part of the angular groove of the valve bore. The valve bore is preferably arranged in front of the blow-off bores in a direction of the muzzle of the gun barrel.

The peculiar feature of this new smoke exhaust device for gun barrels is good function in the case of large as well as very small sizes. This makes it possible, for example, even to mount smoke exhaust devices on gun barrels which are used as inserted barrels for weapons systems. The function of the smoke exhaust device is determined by the check valves which control the velocity of admission, the pressure, and consequently also the blow-off time of the gas. The design and the arrangement of the valve bores can be considered to be particular advantages of these check valves arranged on the circumference of the gun barrel within the smoke exhaust device. According to the patent claims, the check valves consist of springs arranged in layers, which are raised by the gases generated during firing and close again immediately due to their intrinsic tension as soon as the flow of gases generated during firing ceases. The velocity at which this valve design closes is very high. This offers the particular advantage that the desired long gas discharge time is thus achieved. The gas stream flowing from the gun barrel into the smoke exhaust device is , divided by the Y-shaped valve bores, so that the gas flow velocity is reduced. Only a small opening angle of the leaf spring valves is necessary due to the low discharge angle of the inlet openings leading into the smoke exhaust device.

These valves according to the present invention for smoke exhaust devices remain maintenance-free over long firing series and have a very long service life. In addition, only a small overall height is required for this check valve design.

One example of the present invention is shown in the drawing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
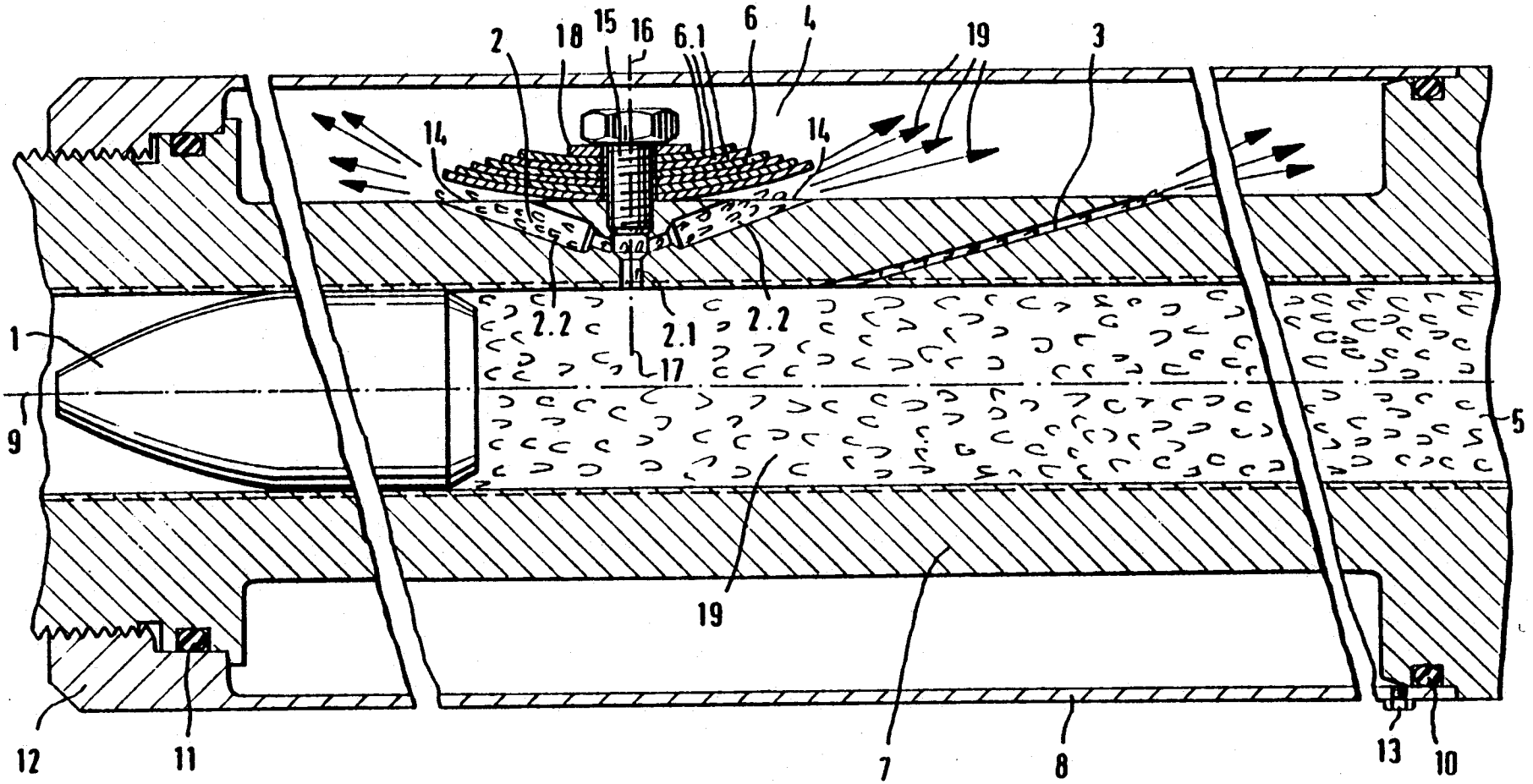
FIG. 1 is a sectional view of a smoke exhaust device of a gun barrel with the check valve opened.

A smoke exhaust device 8 in the form of a hollow cylinder is arranged around a gun barrel 7, preferably in its middle area. In its front and rear end zones, the smoke exhaust device 8 is connected to the gun barrel 7 by sealing rings 10 and 11 in a gas-tight manner. To obtain a smoke exhaust chamber 4, the outer jacket surface of the gun barrel 7 is recessed in an annular shape in the area between the two sealing rings 10 and 11 in the example shown in FIG. 1. In addition, the hollow cylinder of the smoke exhaust device 8 may also be shaped in a radially outwardly extending shape in the area between the two sealing rings 10 and 11 in order to create a smoke exhaust chamber 4 of sufficient size.

As is common in the prior-art smoke exhaust devices, the smoke exhaust device 8 can be screwed firmly onto the gun barrel with a front threaded nut 12 and a retaining ring (not shown here) in this case as well.

For this purpose, the smoke exhaust device 8 may be provided, secured against rotation by a wedge, which is also not shown, at the rear end facing the breechblock. Water that may collect in the smoke exhaust device can be drained off through a drain plug 13 in the rear zone.

A blow-off bore 3, which is directed at a low angle extending to the longitudinal axis 9 of the gun barrel obliquely to the rear end of the gun barrel and opens into the smoke exhaust chamber 4, starts from the caliber bore 5 of the gun barrel 7. A plurality of such blow-off bores 3, which are preferably arranged at regularly spaced locations from one another, may advantageously be provided distributed over the circumference of the gun barrel 7. The blow-off bore 3 opens into the rear zone of the smoke exhaust chamber 4 such that good discharge of the gases collected in the smoke exhaust device 8 is possible without disturbances. A valve bore 2 of Y-shaped design is located in front of the blow-off bore 3 in the direction of the muzzle of the gun barrel. Two side channels 2.2, which are directed opposite to one another through an angle of 120° and open into the smoke exhaust chamber 4, branch off from the lower central channel 2.1. The two obliquely extending channels 2.2 are each directed at low angles to the longitudinal axis 9 of the gun barrel 7. The two inlet openings 14 of the valve bore 2 are closed by a check valve 6, which is formed by a layered leaf spring assembly 6.1. The individual leaf springs 6.1 may be of varying size corresponding to FIG. 1, but they may, of course, also be of the same size. The entire spring assembly is held by a central bolt 15, whose longitudinal axis 16 passes through the longitudinal axis 17 of the lower channel 2.1 of the valve bore 2. A washer 18 is inserted between the head of the bolt and the topmost spring leaf.

The bolt 15 is screwed into a taphole provided in the jacket of the gun barrel 7.

Figure 3:
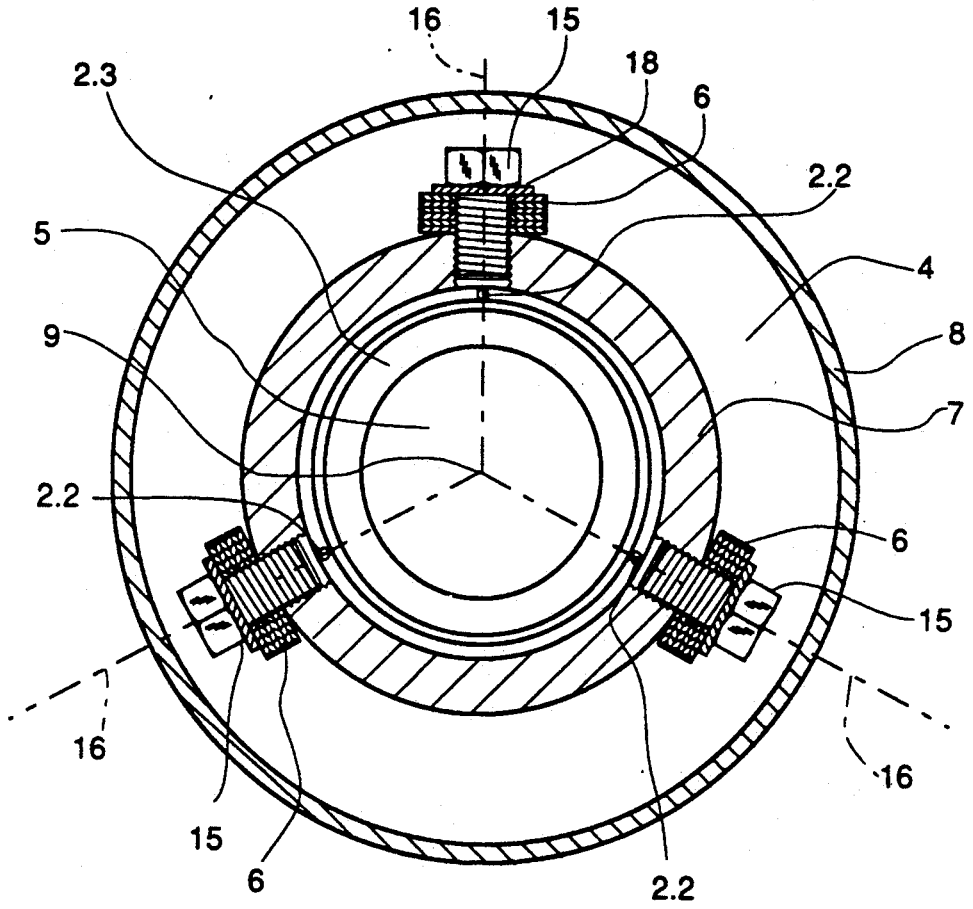
FIG. 3 is a cross-sectional view of another embodiment having an annular groove and a plurality of check valve openings.

Instead of the single valve bore 2 shown in FIG. 1, it is, of course, also possible according to the present invention to have a plurality of valve bores 2 with check valves 6 distributed over the circumference of the gun barrel 7. Two correspondingly arranged lower inlet channels 2.1 may now be provided for all valve bores. Instead of the inlet channels 2.1, it is also possible to provide a circumferential annular groove 2.3 as shown in FIG. 3 from which the obliquely extending channels 2.2 will start.

On firing a shell 1, the gases 19 streaming in behind the shell 1 under a high pressure enter the annular smoke exhaust chamber 4 through the Y- shaped valve bores 2 and the blow-off bores 3. Due to the high gas pressure, the check valves are slightly lifted off from the inlet openings 14 of the valve bores. After the shell 1 has left the gun barrel 7 and the gas pressure in the gun barrel 7 decreases, the check valves 6 close. It should be noted in this connection that the velocity of closure of the check valves is very high due to the special design of the layered leaf springs. This means that despite the great number of inlet bores into the smoke exhaust chamber 4, only relatively slow blow-off of the gases through the blow-off bores 3 is possible. This long blow-off time is desired, in principle, in order for all the gases still present in the gun barrel and especially in the area of the rear breechblock to be entrained during blow-off.

Figure 2:
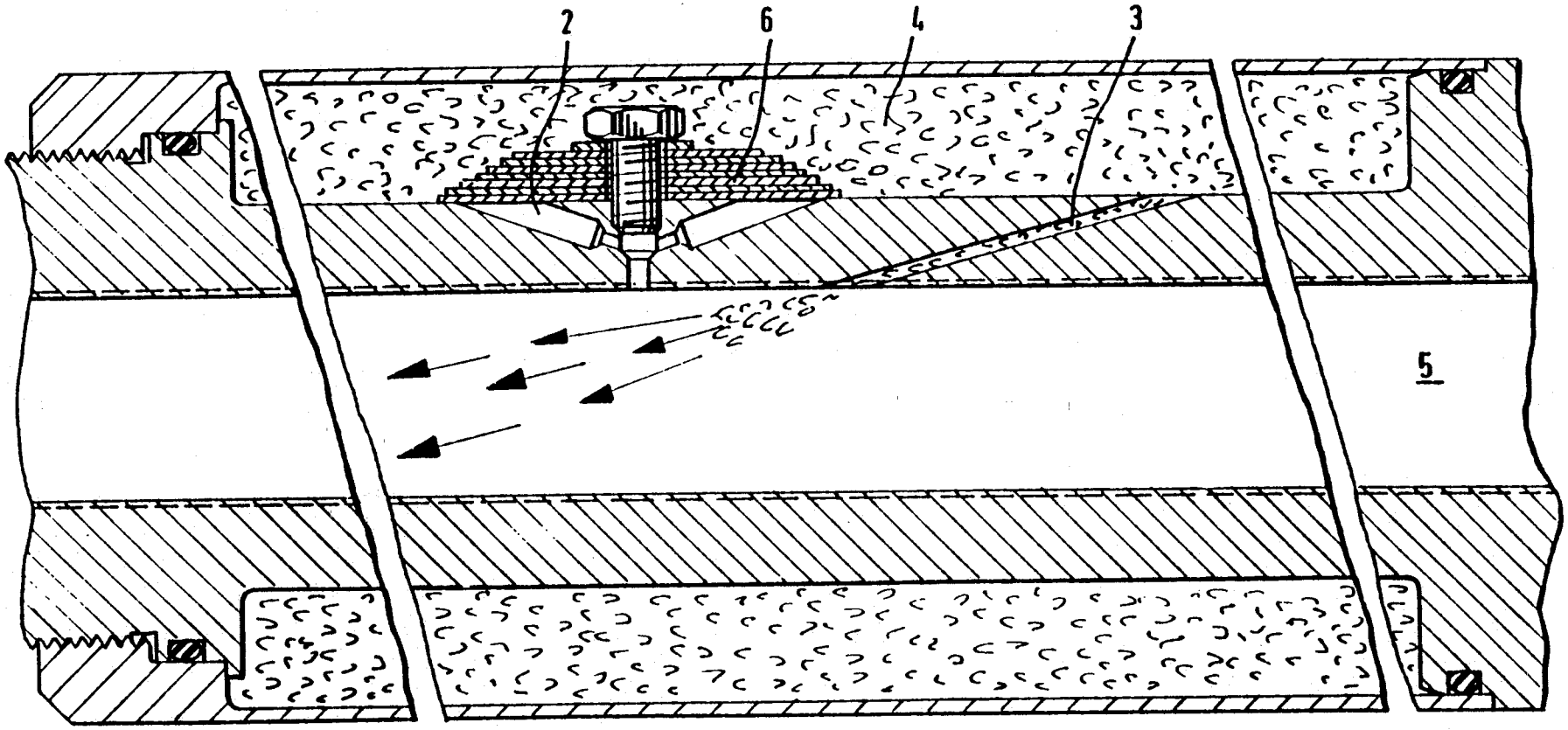
FIG. 2 is a sectional view of the smoke exhaust device according to FIG. 1, but with the check valve closed.

FIG. 2 shows the state of the closed check valve 2 with a smoke exhaust chamber 4 completely filled with gases. The compressed gases in the smoke exhaust chamber 4 now flow through the blow-off bores 3 extending obliquely in the direction of the muzzle of the gun barrel into the gun barrel 7. During the blow-off period of the gas 19 from the smoke exhaust chamber 4, the breechblock (not shown here) of the gun opens, so that a flow from the gun breechblock to the muzzle of the gun barrel is generated, and it entrains the gases present in the rear part of the gun barrel 7 in the forward direction. This principle of operation keeps the combat space of a combat tank or a gun turret free from CO concentrations.

On the whole, the present invention has the advantage of substantially improved operation compared with the state of the art. In addition, there is no longer a health hazard, and longer engagement time and consequently more training are possible. Moreover, the smoke exhaust device is nearly maintenance-free due to the special design of the check valve 6.

The smoke exhaust device 8, which is designed as a hollow cylinder, may be arranged either eccentrically or concentrically around the gun barrel 7. Instead of a smoke exhaust device 8 with circular cross section, other cross sections, e.g., oval or polygonal cross sections, are also possible according to the present invention.

While a specific embodiment of the invention has been shown and described in detail to illustrate the application of the principles of the invention, it will be understood that the invention may be embodied otherwise without departing from such principles.

What is claimed is:

1. An smoke exhaust device for gun barrels, comprising a hollow cylinder arranged around the gun barrel and connected to the gun barrel in a gas-tight manner; at least one blow-off bore extending obliquely to the muzzle of the gun barrel connecting a caliber bore of the gun barrel to the hollow cylinder; a valve bore arranged between the caliber bore of the gun barrel and the smoke exhaust device, said valve bore starting at said caliber bore of the gun barrel and including two oblique inlet openings extending in opposite directions in the shape of a Y, said inlet openings extending at a low angle with respect to a longitudinal axis of the gun barrel; and, check valve means for admitting gas under pressure to the valve bore, said check valve comprising an assembly of layered leaf springs closing off said inlet openings.

2. A smoke exhaust device according to claim 1, wherein a plurality of said valve bores are provided arranged at regularly spaced locations from one another positioned around a circumference of the gun barrel.

3. A smoke exhaust device according to claim 1, wherein said valve bore includes an annular groove connected to one or more of said inlet openings, said annular groove being provided in said caliber bore.

4. An smoke exhaust device according to claim 1, wherein said layered leaf springs are held in said smoke exhaust chambers by a bolt, said bolt having a longitudinal axis passing through a longitudinal axis of a lower part of an annular groove which cooperates with said inlet openings to form said valve bore.

5. A smoke exhaust device according to claim 1, wherein said valve bore is arranged in front of said blow-off bores, in a direction of a muzzle of said gun barrel.

6. A smoke exhaust device for gun barrels, comprising:

a hollow cylinder arranged around the gun barrel and connected to the gun barrel in a gas tight manner;

a blow-off bore extending obliquely with respect to a longitudinal axis of the gun barrel, said blow-off bore connecting a caliber bore of the gun barrel to the hollow cylinder;

a valve bore arranged between the caliber bore of the gun barrel and the smoke exhaust device, said valve bore starting at said caliber bore of the gun barrel and including two oblique inlet openings extending in opposite directions in the shape of a Y, said inlet openings extending at a low angle with respect to said longitudinal axis of the gun barrel;

and, check valve means for admitting gas under pressure to said valve bore, said check valve means comprising an assembly of layered leaf springs fastened at a center to said caliber bore and including a lower layered leaf spring in contact with an outer surface of said caliber bore having a dimension large enough for covering said inlet openings and including a plurality of additional leaf spring elements having dimensions smaller than said first leaf spring for extending over only a portion of said inlet openings.

7. A smoke exhaust device according to claim 6, wherein said valve bore includes an annular groove connected to said inlet openings and connected to at least an additional set of inlet openings.

8. A smoke exhaust device according to claim 6, wherein said layered leaf springs are held in said smoke exhaust device by a bolt extending through a center of said layered leaf springs, said bolt having a longitudinal axis passing through a longitudinal axis of a lower part of an annular groove which cooperates with said inlet openings to form said valve bore.

9. A smoke exhaust device for gun barrels, comprising:

a hollow cylinder arranged around the gun barrel and connected to the gun barrel in a gas tight manner;

a blow-off bore extending obliquely to a longitudinal axis of the gun barrel, said blow-off bore connecting a caliber bore of the gun barrel to the hollow cylinder;

a valve bore arranged between the caliber bore of the gun barrel and the smoke exhaust device, said valve bore starting at said caliber bore of the gun barrel and including two oblique inlet openings extending in opposite directions in the shape of a Y, said inlet openings extending at a low angle with respect to a longitudinal axis of the gun barrel to define an inlet opening region on an outer surface of said gun barrel, said inlet opening region having a dimension defined by said inlet openings;

and, check valve means for admitting gas under pressure to the valve bore, said check valve comprising an assembly of layered leaf springs including a first leaf spring in contact with said gun barrel outer surface, said first leaf spring having a dimension larger than said inlet opening region for extending over each of said inlet openings, and a plurality of leaf springs each having a dimension smaller than said first leaf spring and being successively smaller in dimension than a leaf spring positioned immediately below.

10. A smoke exhaust device according to claim 9, wherein said layered leaf springs are held in said smoke exhaust device by a bolt extending through a center of said layered leaf springs, said bolt having a longitudinal axis passing through a longitudinal axis of a lower part of an annular groove which cooperates with said inlet openings to form said valve bore.

* * * * *